US008246127B1

(12) United States Patent
Clausen

(10) Patent No.: US 8,246,127 B1
(45) Date of Patent: Aug. 21, 2012

(54) ENCLOSED STORAGE CYLINDER WITH ADJUSTABLE SHELVES

(76) Inventor: Mark Kirgiss Clausen, Milwaukee, WI (US)

( * ) Notice: Subject to any disclaimer, the term of this patent is extended or adjusted under 35 U.S.C. 154(b) by 276 days.

(21) Appl. No.: 12/691,348

(22) Filed: Jan. 21, 2010

(51) Int. Cl.
*A47B 97/00* (2006.01)

(52) U.S. Cl. ..... 312/292; 312/293.1; 312/305

(58) Field of Classification Search ..... 312/291–292, 312/293.1, 305
See application file for complete search history.

(56) References Cited

U.S. PATENT DOCUMENTS

| | | | | |
|---|---|---|---|---|
| 383,581 | A | 5/1888 | Barrows | |
| 827,761 | A | 8/1906 | Stromgren | |
| 1,763,724 | A | 6/1930 | Rosenthal | |
| 2,158,085 | A * | 5/1939 | Porter | 108/105 |
| 2,663,608 | A | 12/1953 | Schauer | |
| 2,803,512 | A * | 8/1957 | Band | 312/292 |
| 3,641,950 | A * | 2/1972 | Axhamre | 108/60 |
| 3,807,826 | A * | 4/1974 | Peckenpaugh | 312/305 |
| 3,957,159 | A | 5/1976 | Radek | |
| 4,049,154 | A * | 9/1977 | Burks | 221/76 |
| 4,126,366 | A | 11/1978 | Handler | |
| 4,239,311 | A | 12/1980 | Brownlee | |
| 4,269,124 | A | 5/1981 | Rosenthal | |
| 4,938,549 | A * | 7/1990 | Potter | 312/305 |
| 5,313,393 | A * | 5/1994 | Varley et al. | 705/28 |
| 5,337,920 | A * | 8/1994 | Clausen | 312/97.1 |
| 5,702,011 | A | 12/1997 | Carroll | |
| 5,813,528 | A | 9/1998 | Bliek | |
| 6,296,181 | B1 * | 10/2001 | Noblet et al. | 312/292 |
| 6,367,895 | B1 * | 4/2002 | Huffman et al. | 312/97.1 |
| 6,419,332 | B1 | 7/2002 | Caldwell | |
| 6,588,865 | B2 | 7/2003 | Caldwell | |
| 7,854,332 | B1 * | 12/2010 | Clausen | 211/41.12 |

* cited by examiner

*Primary Examiner* — Hanh V Tran

(57) ABSTRACT

A storage cylinder within an enclosed storage unit that secures stored items and inhibits shelf repositioning during normal operation. The design allows shelf reconfiguration during maintenance and restocking. The storage cylinder contains rectangular-shaped and triangular-shaped storage areas. Most importantly, all storage areas (including those with a generally triangular-shape) have parallel faces with horizontal slots that are used for shelf support. Such a design requires radial movement to reposition the shelves. In its closed position the maintenance door or baffle mechanism restricts shelf removal. Therefore, during normal operation, when the maintenance door or baffle is closed, shelf repositioning is not possible. However, access panels still allow removal of stored objects. During maintenance or restocking, the maintenance door or baffle mechanism allows removal and installation of shelves.

10 Claims, 6 Drawing Sheets

ENCLOSED STORAGE CYLINDER WITH ADJUSTABLE SHELVES

CROSS-REFERENCE TO RELATED APPLICATIONS

Not Applicable.

FEDERALLY SPONSORED RESEARCH

Not Applicable.

SEQUENCE LISTING OR PROGRAM

Not Applicable.

BACKGROUND OF THE INVENTION

1. Field of Invention

This invention relates to the secure storage and easy retrieval of objects of various vertical dimensions in an enclosed storage cylinder.

Storage machines that use rotating storage cylinders are well known (e.g. sandwich machines). In such machines the storage cylinder has a group of storage areas that run vertically along one segment of the cylinder. The cylinder rotates until the desired segment faces the access opening. The access opening is blocked by a vertical stack of doors, where the doors are usually of uniform height. One of the doors opens to provide access to a stored item.

Most of these storage machines have the storage areas configured at the factory. The mix of sizes of storage areas is determined when the machine is ordered. This requires a careful analysis of storage needs before the machine is configured. A better system would allow the configuration of storage areas using readily available tools after receiving the machine. The best system would allow reconfiguration without tools.

What sets this invention apart from the prior art is:

1. Both the rectangular-shaped and the triangular-shaped storage areas of the storage cylinder have drawer style shelves that require radial motion for removal and installation.
2. Drawer-style shelves, combined with a properly designed enclosure, prohibit shelf repositioning during normal operation but provide access to the shelves for their easy removal and repositioning during maintenance and restocking.
3. This invention provides variable vertical spacing between shelves. This attribute is especially useful when adding new items of different heights to the storage cylinder.
4. Since many stored objects are rectangular in shape and do not fit well into the pie-slice partitions of a typical storage cylinder, this invention uses H-shaped partitioning, eliminating the unused portion of the pie-slice and increasing storage efficiency for rectangular objects.
5. This invention allows for various partitioning arrangements to meet a variety of storage requirements.
6. All partitions share common walls to provide efficient use of partitioning material.
7. An enclosure, which surrounds the storage cylinder, ensures the secure storage of stored objects.

2. Prior Art

Other inventors have created storage cylinders with rectangular shelving, but none has incorporated all of the benefits of this invention.

Only Peckenpaugh (U.S. Pat. No. 3,807,826: April 1974) and Stromgren (U.S. Pat. No. 827,761: August 1906) provide secure storage for stored objects.

Rosenthal (U.S. Pat. No. 4,269,124: May 1981) does not provide rectangular storage or partitioning. Further, he does not make full use of the center area around the axis of rotation.

Barrows (U.S. Pat. No. 383,551: May 1888), Porter (U.S. Pat. No. 2,158,085: May 1939), Axhamre (U.S. Pat. No. 3,641,950: February 1972), Potter (U.S. Pat. No. 4,938,549: July 1990), and Bliek (U.S. Pat. No. 5,813,528: September 1998) have shelves with adjustable heights in a cylindrical cylinder but do not provide rectangular storage areas.

Stromgren (U.S. Pat. No. 827,761: August 1906), Schauer (U.S. Pat. No. 2,663,608: December 1953), Brownlee (U.S. Pat. No. 4,239,311: December 1980) and Caldwell (U.S. Pat. No. 6,419,332: July 2002, and U.S. Pat. No. 6,588,865: July 2003) provide rectangular storage drawers but do not allow the user to adjust the shelf height.

Rosenthal (U.S. Pat. No. 1,763,724: June 1930) and Handler (U.S. Pat. No. 4,126,366: November 1978) have rectangular adjustable-height shelves within a cylindrical space but omit partitioning the storage areas. Further, they do not use the center area around the axis of rotation, resulting in an inefficient use of space.

Radek (U.S. Pat. No. 3,957,159: May 1976) has adjustable vertical shelving but without rectangular storage areas. In addition, he wastes storage area around the axis of rotation.

Peckenpaugh (U.S. Pat. No. 3,807,826: April 1974) has adjustable vertical shelving and parallel sides for rectangular storage areas, but he wastes much of the space between his shelving and the rectangular-section within which his shelving is inscribed. In addition, shelving in the corners of his invention are not usable for rectangular objects, and his triangular shelving does not have parallel sides.

Clausen (U.S. Pat. No. 5,337,920: August 1994) provides rectangular storage drawers and uses a large part of the central circular area for storage. However, one can not adjust the shelf height. His corner storage areas are triangularly shaped and do not have parallel sides.

Carroll (U.S. Pat. No. 5,702,011: December 1997) has adjustable rectangular shelving but his invention wastes much available space between the storage shelves and the circular area within which it is inscribed.

Table 1 contrasts the prior art with this invention.

TABLE 1

Comparing the Prior Art to This Invention.

| Name, Date Patent No. | Attributes | | | | | |
|---|---|---|---|---|---|---|
| | Radial Motion Required for Removal and Insertion of Shelving | Secure Access to Stored Objects | Space Efficient for rectangular objects | Has Adjustable Shelving | Fully Uses Inscribed Storage Area | Efficient Use of Partitioning Material |
| Clausen, M: (This Invention) | X | X | X | X | X | X |
| Axhamre, F. L.: Feb. 15, 1972 No. 3,641,950 | | | | X | X | X |
| Barrows, A.: May 29, 1888 No. 383,551 | X | | | X | X | |

TABLE 1-continued

Comparing the Prior Art to This Invention.

| Name, Date Patent No. | Attributes: Radial Motion Required for Removal and Insertion of Shelving | Secure Access to Stored Objects | Space Efficient for rectangular objects | Has Adjustable Shelving | Fully Uses Inscribed Storage Area | Efficient Use of Partitioning Material |
|---|---|---|---|---|---|---|
| Bliek, K.: Sep. 29, 1998 No. 5,813,528 | | | | | X | X |
| Brownlee, S. S.: Dec. 16, 1980 No. 4,239,311 | | | X | | | |
| Caldwell, R. C. Jr.: Jul. 16, 2002 No. 6,419,332 | | | X | | | |
| Caldwell, R. C., Jr.: Jul. 8, 2003 No. 6,588,865 B2 | | | X | | | |
| Carroll, F. A.: Dec. 30, 1997 No. 5,702,011 | X | | X | X | | |
| Clausen, M. K.: Aug. 16, 1994 No. 5,337,920 | | | X | | X | |
| Handler, M. E.: Nov. 21, 1978 No. 4,126,366 | | | X | X | | |
| Peckenpaugh, T. L.: Feb. 20, 1972 No. 3,807,826 | | X | X | X | X | |
| Porter, S. B. C.: Jun. 25, 1935 No. 2,158,085 | X | | | X | X | X |
| Potter, F.: Jul. 3, 1990 No. 4,938,549 | X | | X | X | X | |
| Radek, J. R.: May 18, 1976 No. 3,957,159 | | | | X | X | |
| Rosenthal, A. H.: Jun. 17, 1930 No. 1,763,724 | X | | X | | | |
| Rosenthal, Stanley H.: May 26, 1981 No. 4,269,124 | | | | X | X | |
| Schauer, W. E.: Dec. 22, 1953 No. 2,663,608 | | | X | | X | |
| Stromgren, G. A.: Aug. 7, 1906 No. 827,761 | | X | X | | X | |

OBJECTS AND ADVANTAGES

The storage unit of this invention provides easy, secure retrieval of stored objects while providing space-efficient storage for rectangular objects within a storage cylinder. Because this invention allows one to install shelving at different vertical elevations, it accommodates objects of different heights without wasting valuable storage space. During maintenance or refilling operations, one can easily remove and reposition shelving without the use of tools; but, during normal operation, shelving cannot be adjusted or removed. Lastly, this invention uses less partitioning material than an equivalent storage column of non-cylindrical design.

Although the storage unit of this invention may be used with a single storage cylinder, the design provides additional advantages when several storage cylinders are grouped together. Such machines allow storage cylinders to be placed close together and rotated without interference. In contrast, square or rectangular storage columns are less space-efficient and must be placed far enough apart so that, when rotated, their outer turning edges do not collide.

SUMMARY

With its cylindrical design, this invention efficiently uses the available storage area; plus, its H-pattern partitioning provides storage for rectangular objects. In addition, adjustable-height shelving accommodates stored objects with various vertical dimensions. Furthermore, one may select various partitioning arrangements to meet storage needs. And, by sharing common walls, minimal partitioning material is used. Most importantly, all shelving (including those with a generally triangular shape) is supported with horizontal slots and has parallel faces. Such a design requires radial movement to reposition the shelves. A maintenance door or baffle mechanism restricts shelf radial motion during normal operation while access panels provide secure retrieval of desired objects. When open (during maintenance or restocking), the maintenance door or baffle mechanism allows shelves to be removed and installed radially, allowing easy repositioning of the shelves.

DRAWINGS

Figures

Figure 4:
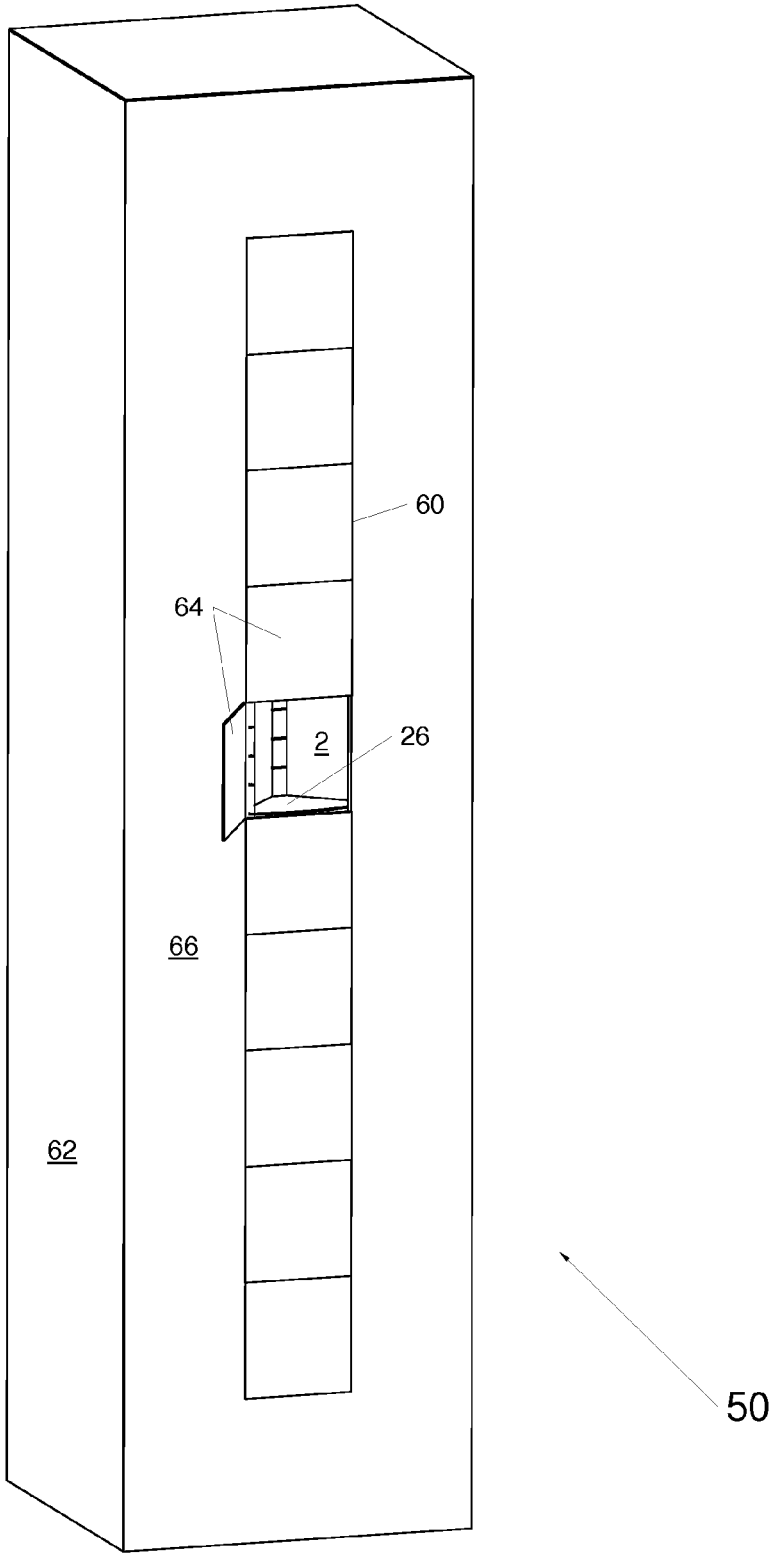
FIG. 4 shows the storage cylinder of FIG. 1 in an enclosure with an access opening and hinged access panels that provide access to the storage areas.
Figure 5B:
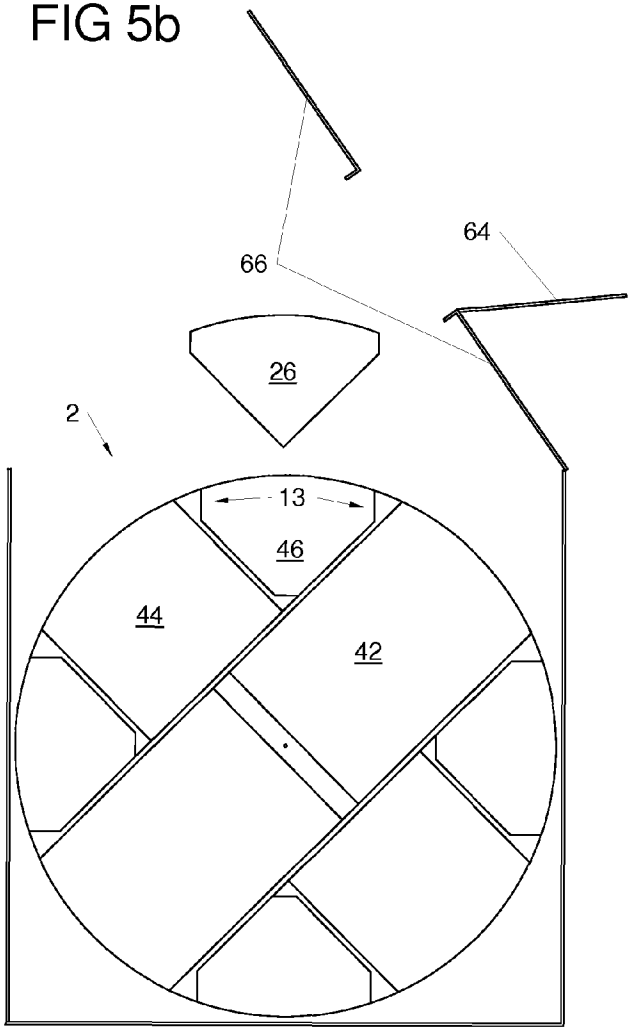
Figure 5A:
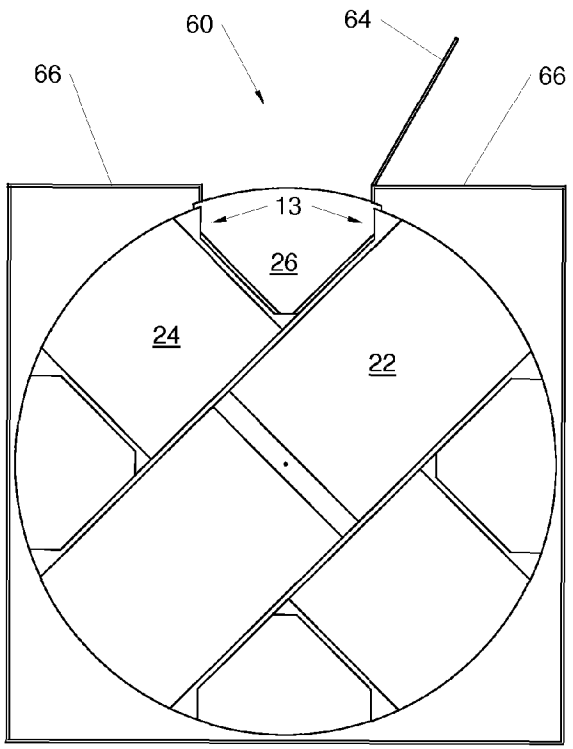

FIG. 5*a* reveals a removed sectional view of the storage unit of FIG. 4 showing a corner shelf partially removed but blocked from full removal by the maintenance door.

FIG. 5*b* is the storage unit of FIG. 5*a* with the maintenance door open and a corner shelf fully removed.

Figure 6B:
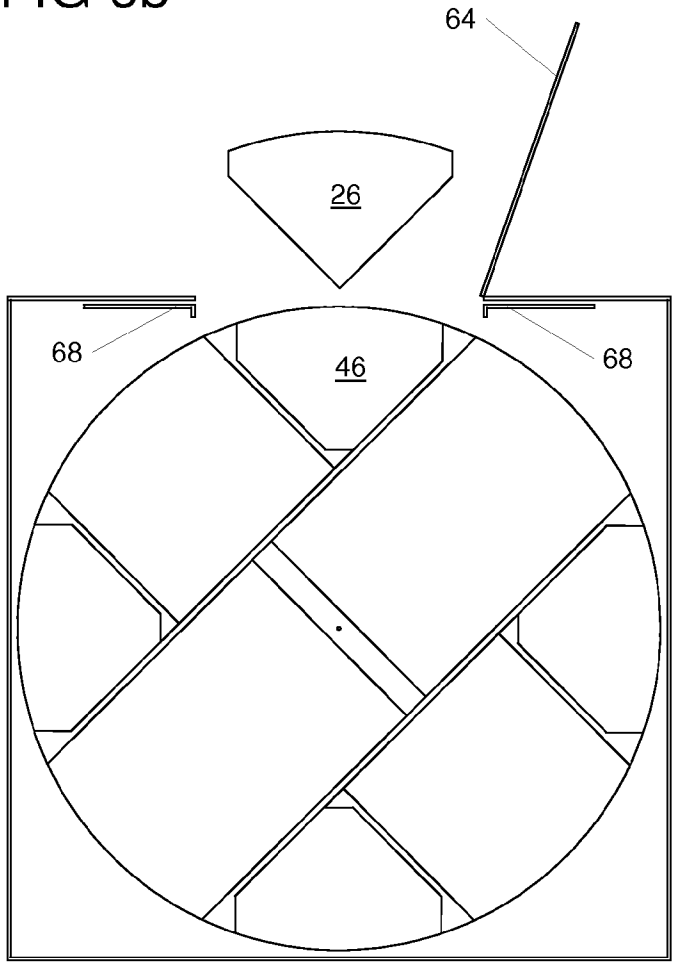
Figure 6A:
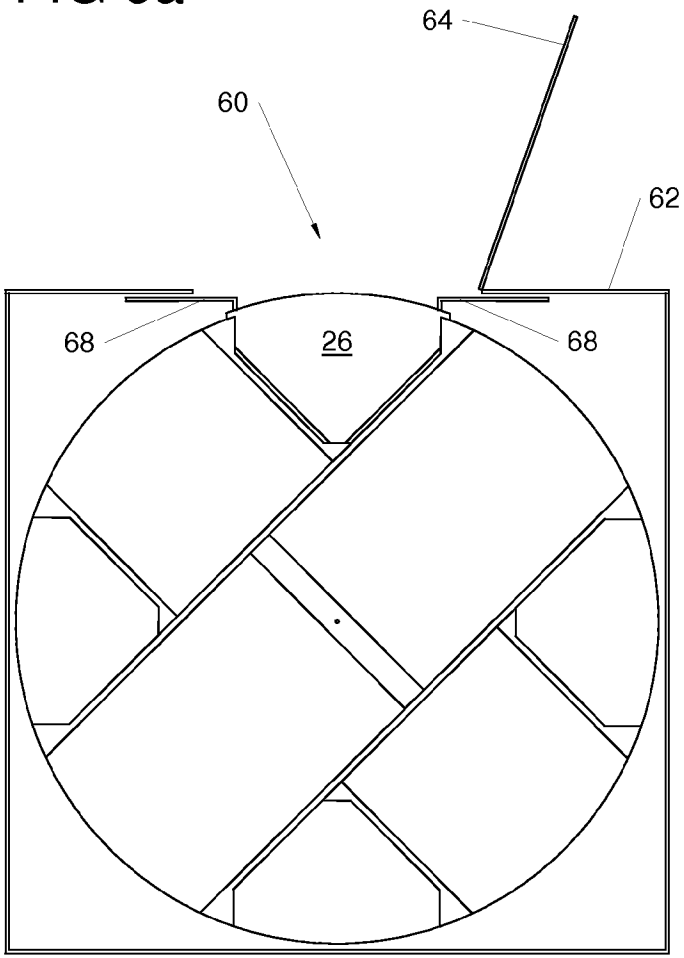

FIGS. 6*a* and 6*b* show the storage unit of FIGS. 5*a* and 5*b* where the maintenance door has been replaced with a baffle mechanism.

| DRAWINGS - REFERENCE NUMERALS: | |
|---|---|
| 2 | storage cylinder |
| 3 | alternative storage cylinder |
| 5 | bottom support |
| 6 | inner partition |
| 8 | left partition |
| 10 | right partition |
| 12 | main partition |
| 13 | parallel face |
| 14 | horizontal slot |
| 18 | vertical slot |
| 22 | large shelf |
| 24 | small shelf |
| 26 | corner shelf |
| 28 | retaining lip |
| 38 | outside face |
| 40 | inside face |
| 42 | large rectangular area |
| 44 | small rectangular area |
| 46 | triangular area |
| 50 | storage unit |
| 60 | access opening |
| 62 | enclosure |
| 64 | access panel |
| 66 | maintenance door |
| 68 | baffle |

DETAILED DESCRIPTION

Figure 1:
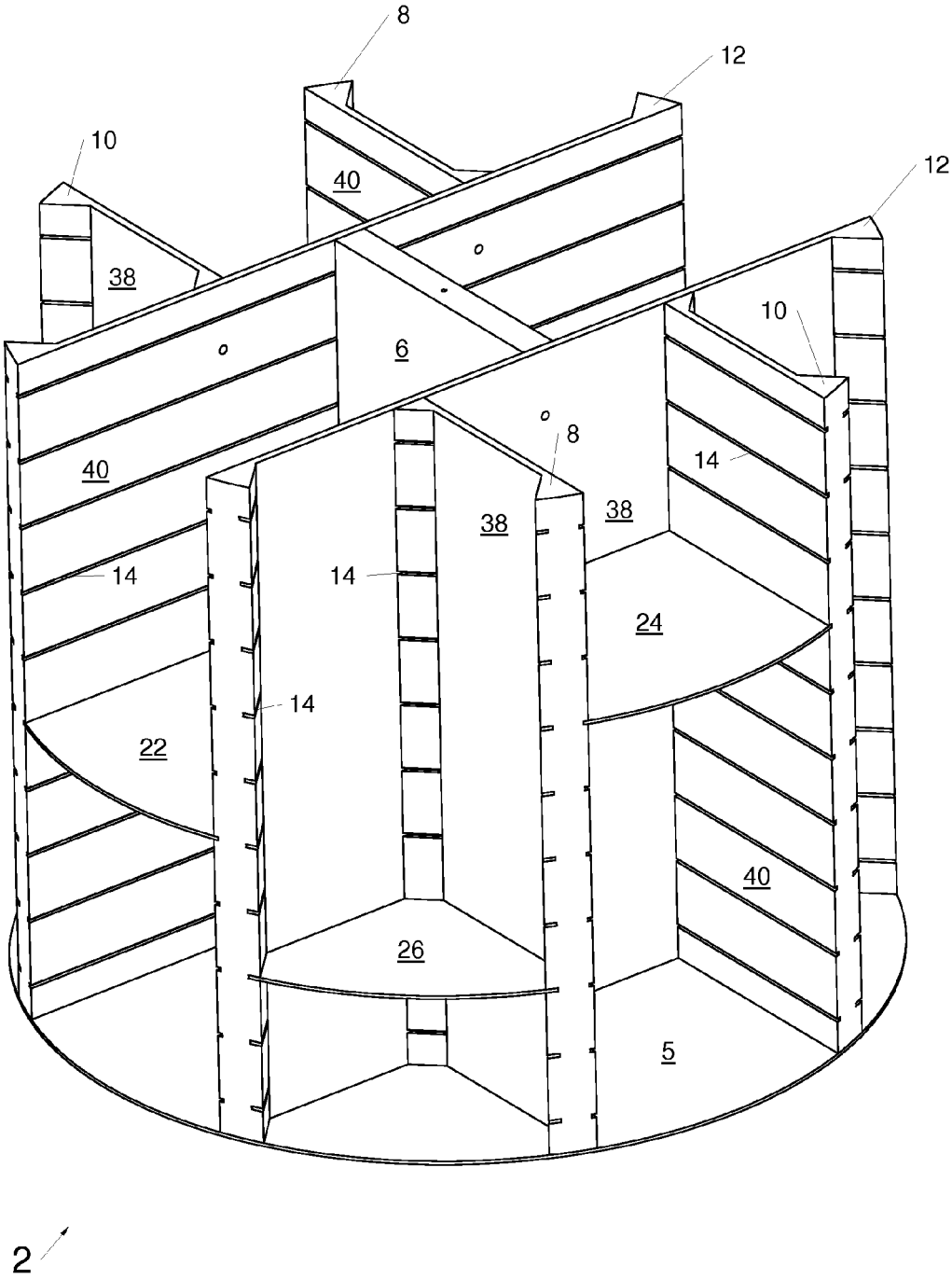
FIG. 1 shows a perspective view of a storage cylinder with parallel partitions, an inner partition, and slots to support shelving.

FIG. 1 depicts a storage cylinder 2 consisting of two left partitions 8, two right partitions 10, two main partitions 12, and a inner partition 6. All partitions have the same height. Partitions 8, 10, and 12 have an inside face 40 and an outside face 38. These partitions form two mirror-image subassemblies, where each subassembly consists of one left partition 8 and one right partition 10 attached to the outside face 38 of one main partition 12. Partitions 6, 8, 10, 12 are fastened together with screws, rivets, or other methods, such as welding or gluing.

Figure 2:
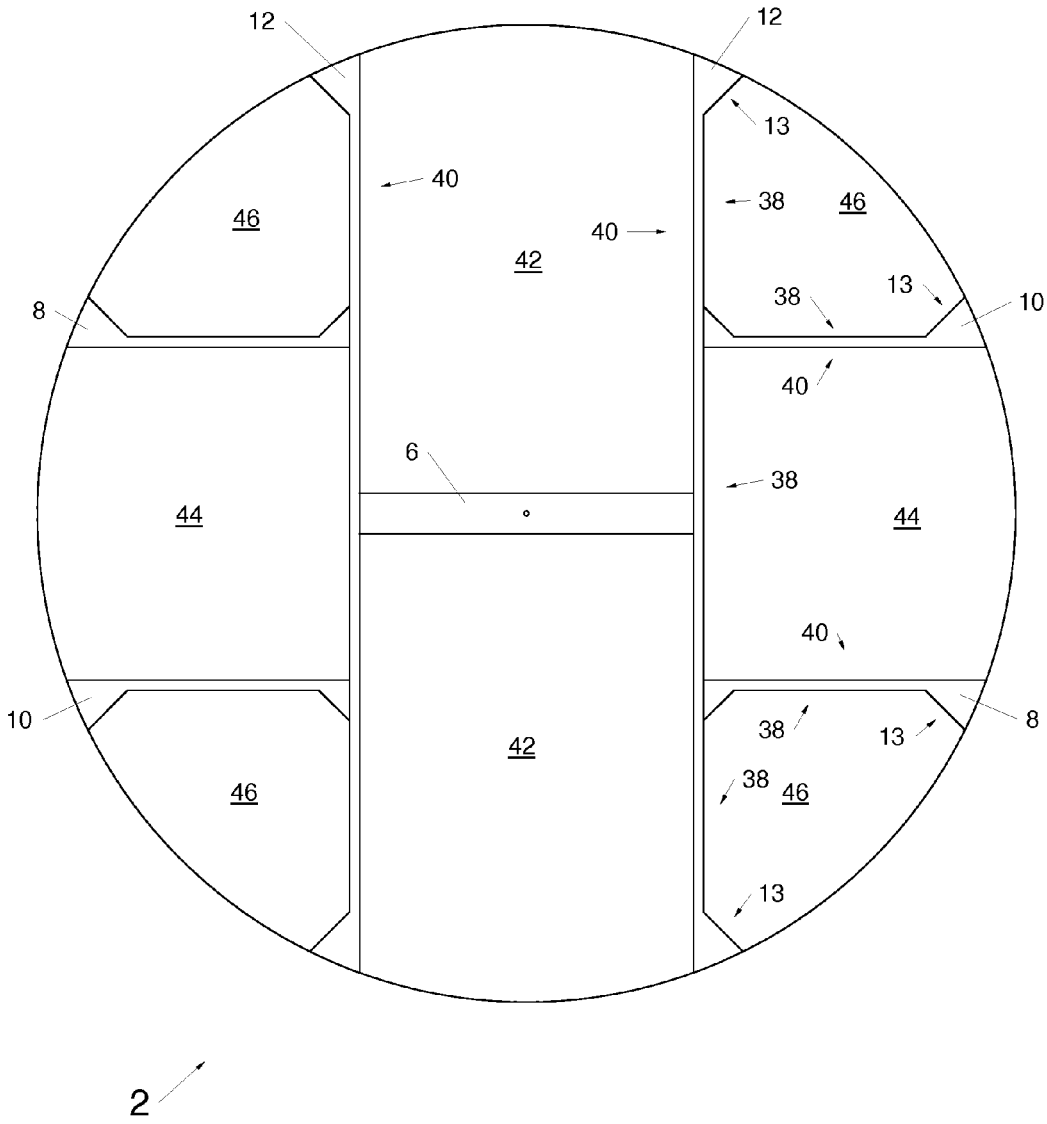
FIG. 2 shows a top view of the storage cylinder of FIG. 1, revealing H-pattern partitioning and parallel faces.

FIG. 2 shows how the partitioning arrangement defines the storage areas 42, 44, 46. The inside face 40 of partitions 8 and 10 along with the outside face 38 of partition 12 form a small rectangular area 44. The outside face 38 of main partition 12 and the outside face 38 of left partition 8 form a triangular area 46. Similarly, the outside faces 38 of partitions 12 and 10 also form a triangular space 46.

FIGS. 1 and 2 depict two mirror-image subassemblies attached to the narrow vertical edges of inner partition 6 so that the inside face 40 of the main partitions 12 face each other. The inside faces 40 of the two partitions 12 and the two wide vertical faces of inner partition 6 form two large rectangular areas 42 arranged in an H-pattern. The H-pattern opens up the center area to provide more useful storage capacity than the pie-piece or wedged-shaped areas common in most cylindrically shaped storage columns (e.g. lazy Susan's). By adding right and left side partitions 8 and 10 to the "H", one forms two smaller rectangular areas 44 and four triangular areas 46 (FIG. 2).

As shown in FIG. 1, partitions 8, 10, and 12 have horizontal slots 14 to position shelving. One installs a storage surface or shelf 22, 24, 26 in the storage cylinder 2 by horizontally aligning the edges of the shelf with a pair of slots 14 and moving the shelf radially inward toward the center of the cylinder. Similarly, the shelf can be removed by moving the shelf radially outward away from the center of the cylinder.

Figure 3:
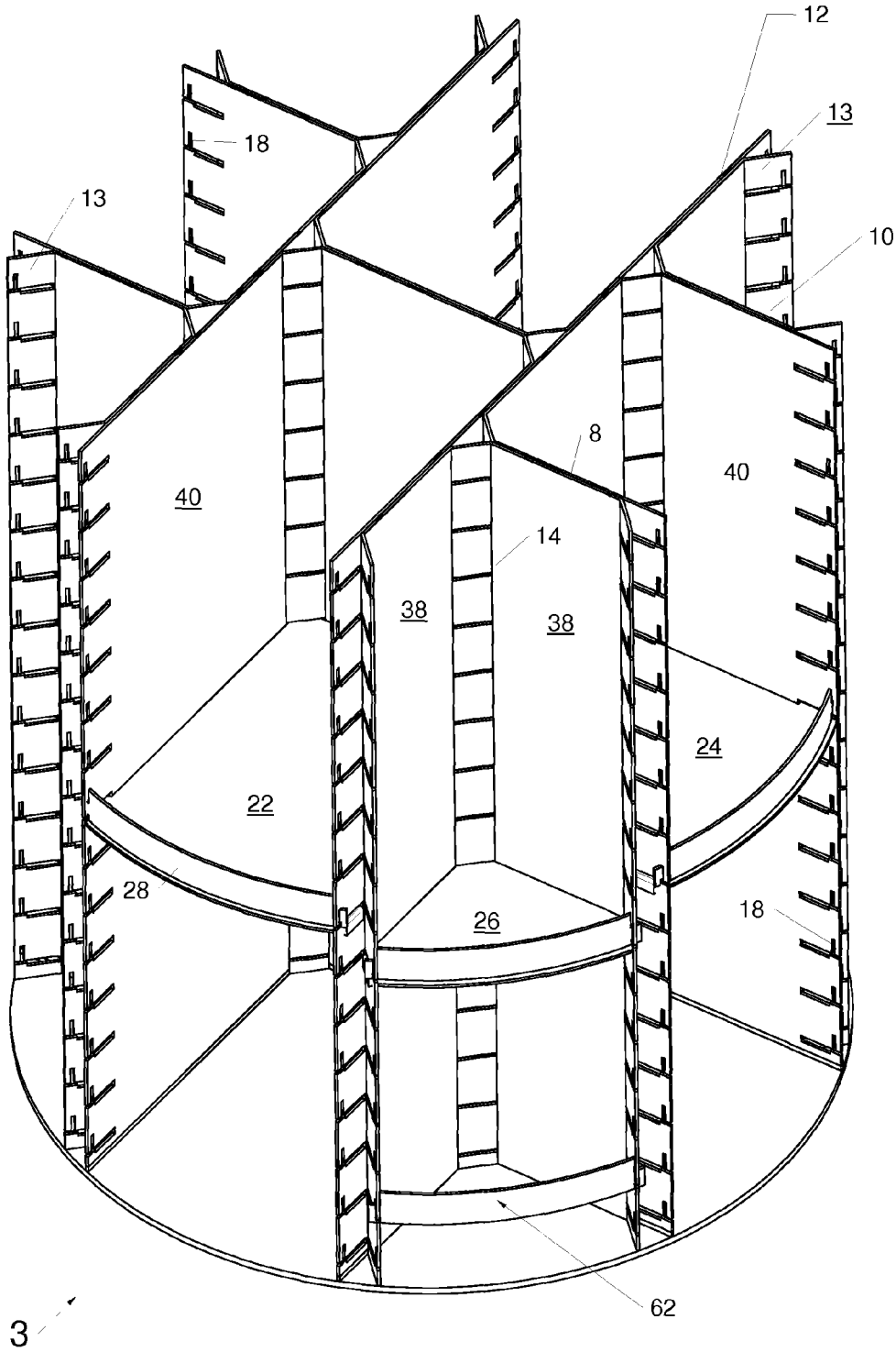
FIG. 3 shows a perspective view of an alternative storage cylinder with a different method for attaching shelves.

FIG. 3 shows an alternative storage cylinder 3 with a different method of shelf attachment. Here, both the rectangular 22, 24 and triangular 26 shelves are supported by horizontal slots 14 at their corners. As with storage cylinder 2, shelves can be removed or inserted only with radial motion. In addition, vertical slots 18 allow the use of shelf retaining lips 28.

FIG. 4 shows an enclosed storage cylinder 2 rotatably mounted in an enclosure 62. The enclosure has an access opening 60 equipped with several hinged panels 64 to provide access to various vertical storage areas of storage cylinder 2. One of the access panels 64 is shown in its open position, allowing access to a selected storage area above shelf 26. The other access panels 64 are shown in their closed positions. A hinged maintenance door 66, which contains the access opening 60 and access panels 64, is shown in its closed position. When in its open position (see FIG. 5*b*), the maintenance door 66 allows access to the entire storage cylinder 2 for maintenance and restocking.

FIGS. 5*a* and 5*b* depict a removed sectional view of storage unit 50 of FIG. 4. In FIG. 5*a* the maintenance door 66 is closed and the access panel 64 is open. As can be seen, parallel faces 13 and slots 14 (FIG. 1) restrict shelf 26 to radial movement, and the amount of radial movement is restricted by door 66 so that the shelf cannot be removed from the cylinder 2. In FIG. 5*b* maintenance door 66 is in its open position. Now shelf 26 can be moved radially outward beyond the parallel faces 13 and removed from the storage cylinder 2. Together FIGS. 5*a* and 5*b* show how the parallel faces 13 and slots 14 in conjunction with maintenance door 66 restrict removal of shelf 26 during normal operation (FIG. 5*a*) but allow easy shelf removal (FIG. 5*b*) during restocking operations. Similarly, inside parallel faces 40 of rectangular areas 42 and 44 and horizontal slots 14 restrict removal of shelves 22, 24 during normal operation but allow easy removal of shelves when door 66 is open.

FIGS. 6*a* and 6*b* also depict a removed sectional view of storage unit 50 of FIG. 4; however, in this figure the maintenance door 66 has been replaced by baffle 68 and a reshaped enclosure 62. The baffle 68 consists of two vertical panels that run the full length of storage cylinder 2. The panel motion is controlled by tracks (not shown) that allow the panels to move towards each other to narrow access opening 60 or away from each other to widen the opening. When the two baffle panels 68 are in a closed position as shown in FIG. 6*a*, they block the removal of shelf 26. When the baffle panels are in an open position as shown in FIG. 6*b*, they no longer restrict the removal or insertion of shelf 26.

OPERATION

When the maintenance door 66 or baffle 68 is open (FIGS. 5*b* and 6*b*), one may configure storage cylinder 2 as follows: A stored object is placed on bottom support 5, and a shelf (22,24,26) is then radially installed directly above it. One then places another object on this shelf and installs another shelf above it. One continues this process until the storage cylinder is filled.

During normal operation the storage cylinder 2 rotates until a selected item is brought to the access opening 60 (FIGS. 4, 5*a* and 6*a*). Then, one or more access panels 64 open to provide access to the desired item(s).

In some situations, it may be desirable to use a retaining lip 28 in addition to the shelves 22, 24, 26 to more securely hold the stored object.

CONCLUSION, RAMIFICATIONS, AND SCOPE

The most important feature of this invention is the radial motion of shelving 22, 24, 26 combined with a maintenance door 66 or baffle 68. The parallel faces 13 and 40, horizontal slots 14, and maintenance door 66 or baffle 68 prohibit reconfiguration of shelving during normal operation. When the maintenance door 66 or baffle 68 is open, one can move the shelving radially outward (to remove a shelf) or radially inward (to install a shelf).

In addition, while most storage cylinders do not provide efficient storage space for rectangular objects and waste space at their center, this invention eliminates these problems through the use of H-shaped partitioning and also provides the user with the flexibility to store objects of various heights. Also, since H-shaped partitions share storage walls, one also obtains savings in material.

Further, when one compares a rotatable square-shaped storage column (e.g. book display) with a turning radius equal to that of the cylindrical storage column of FIG. 2, one sees immediately that a rotatable square storage column provides less usable storage than the circular column. In fact, calculations show that a circular storage column provides more than 50% additional storage area than the equivalent rotatable square storage column.

Adjustable shelving allows one to install shelves at any desired vertical location and to reposition the shelving whenever required.

Although not shown, one may select various partitioning layouts depending upon storage requirements.

Finally, a user may group several storage cylinders to create a storage machine with even greater flexibility and space savings.

Although the description above contains many specificities, these should not be construed as limiting the scope of the invention but as merely providing illustrations of some of the presently preferred embodiments of this invention. For example:

Partitions may be held together by various fastening methods, i.e. riveting, bolting, gluing, welding, or they may be created as a single extrusion.

Partitions may be constructed to serve a variety of storage needs. For example, inner partition 6 may be moved off-center.

Shelves need not be exactly rectangular in shape. The back dimension of the rectangular space may be shorter or longer than the front dimension (trapezoidal).

Shelving may be held in place using any number of methods, e.g. slots, ridges, screws, dowels, etc.

Shelving may require tools for installation and removal.

I claim:

1. A general purpose storage cylinder where said cylinder has a cylindrical axis and circumferential edge comprising:

a. a plurality of partitions with faces that are uniformly shaped along the vertical length of the partitions where said partitions run the vertical length of said storage cylinder where said partitions are positioned to divide a circular cross-section of said storage cylinder into a plurality of storage areas where at least some of said storage areas are approximately rectangular and others are approximately triangular where said rectangular storage areas are formed by generally flat faces of at least three partitions where two of said faces are cooperating faces that are parallel and opposite each other at said circumferential edge and where each of said triangular storage areas are formed by two partitions one of said partitions has an inner flat face positioned away from the circumferential edge and each partition has an outer flat face that intersects the circumferential edge and where said inner face forms the rear portion of said triangular storage area and the outer faces form the outer portion of said storage area and where said outer faces are cooperating faces that are parallel and opposite each other at said circumferential edge;

b. a plurality of generally flat horizontal storage shelves where said shelves are shaped to fit said storage areas;

c. a plurality of attachment means spaced along the vertical lengths of said cooperating faces for joining said shelves with said partitions such that said shelves may be installed at a plurality of positions along the vertical length of said partitions and further that said shelves can only be inserted and removed when the main component of motion of said shelf is substantially radial with respect to the axis of said storage cylinder.

2. The storage cylinder of claim 1 wherein said attachment means are horizontal slots in said cooperating faces whereby said storage shelves can be inserted and removed by aligning edges of said shelves with said horizontal slots and moving the shelves radially with respect to the axis of said storage cylinder.

3. The storage cylinder of claim 1 wherein said partitions are a multiplicity of separate pieces bonded together with a bonding means.

4. The storage cylinder of claim 1 further including an enclosure where said storage cylinder is rotatably mounted within said enclosure.

5. The storage cylinder of claim 4 wherein said enclosure comprises a plurality of walls where at least one wall of said enclosure contains a maintenance door with an access opening where the height of said access opening is approximately equal to the height of said storage cylinder and which has a width smaller than the width of said storage shelves and further where said maintenance door has an open and closed position such that in its closed position blocks removal and installation of said shelves and in its open position allows insertion and removal of said shelves.

6. The storage cylinder of claim 4 wherein said enclosure comprises a plurality of walls where at least one wall of said enclosure contains an access opening where the height of said access opening is approximately equal to the height of said storage cylinder and which has a width wider than the width of said storage shelves and further where said enclosure contains a baffle mechanism that is approximately the same height as said access opening and moveably fixed to said wall containing said access opening and adjacent to said access opening where said baffle mechanism can be moved horizontally between a closed and an open position such that in its closed position said baffle partially blocks said access opening thereby blocking removal of said shelves and in its open position does not block said access opening whereby during normal operation the shelves cannot be removed or installed but in said open position said baffle allows easy removal and installation of shelves.

7. A storage unit comprising:

a) an enclosure further comprising walls and a maintenance door;

b) a storage cylinder rotatably mounted within said enclosure where said storage cylinder has a cylindrical axis and circumferential edge and further comprises:

(1) a plurality of partitions with faces that are uniformly shaped along the vertical length of the partitions where said partitions run the vertical length of said storage cylinder and where said partitions are positioned to divide a circular cross-section of said storage cylinder into a plurality of storage areas where said storage areas are formed by a plurality of generally flat faces where at least some of said storage areas are approximately triangular where each of said triangular storage areas are formed by two partitions where one of said partitions has an inner flat face positioned away from the circumferential edge and each partition has an outer flat face that intersects the circumferential edge and where said inner face forms the rear portion of said triangular storage area and the outer faces form the outer portion of said storage area and where said outer faces are cooperating faces that are parallel and opposite each other at said circumferential edge;

(2) a plurality of generally flat horizontal storage shelves where said shelves are shaped to fit said storage areas;

(3) a plurality of attachment means similarly spaced long the vertical lengths of said cooperating faces for joining said shelves with said partitions such that said shelves may be installed at a plurality of positions along the vertical length of said partitions and further that said shelves can only be inserted and removed when the main component of motion of said shelf is substantially radial with respect to the axis of said storage cylinder;

c) an access opening in said maintenance door where the height of said access opening is approximately equal to the height of said storage cylinder and where the width of said access opening is slightly smaller than the width of said shelves and further where said maintenance door has an open and a closed position such that in its closed position said maintenance door blocks radial motion of said shelves and in its open position allows radial motion of said shelves whereby during normal operation with the maintenance door in its closed position the shelves cannot be removed or installed but in its open position said maintenance door allows easy removal and installation of said shelves.

8. The storage unit of claim 7 further comprising a plurality of access panels which, when open, allow access to the storage cylinder through the access opening and, when closed, inhibit access to the storage cylinder.

9. A storage unit comprising:

a) an enclosure;

b) a storage cylinder rotatably mounted within said enclosure where said storage cylinder has a cylindrical axis and circumferential edge and further comprises:

(1) a plurality of partitions with faces that are uniformly shaped along the vertical length of the partition where said partitions run the vertical length of said storage cylinder and where said partitions are positioned to divide a circular cross-section of said storage cylinder into a plurality of storage areas where said storage areas are formed by a plurality of generally flat faces where at least some of said storage areas are approximately triangular where each of said triangular storage areas are formed by two partitions where one of said partitions has an inner flat face positioned away from the circumferential edge and each partition has an outer flat face that intersects the circumferential edge and where said inner face forms the rear portion of said triangular storage area and the outer faces form the outer portion of said storage area and where said outer faces are cooperating faces that are parallel and opposite each other at said circumferential edge;

(2) a plurality of generally flat horizontal storage shelves where said shelves are shaped to fit said storage areas;

(3) a plurality of attachment means spaced along the vertical lengths of said cooperating faces for joining said shelves with said partitions such that said shelves may be installed at a plurality of positions along the vertical length of said partitions and further that said shelves can only be inserted and removed when the main component of motion of said shelf is substantially radial with respect to the axis of said storage cylinder;

c) an access opening in said enclosure where the height of said access opening is approximately equal to the height of said storage cylinder and the width of said access opening is larger than the width of the widest of said shelves;

d) a baffle mechanism further comprising at least one baffle panel where said baffle panel is approximately the same height as said access opening and moveably mounted adjacent to said access opening and further where said baffle panel can be moved horizontally between a closed and an open position such that in its closed position said baffle partially blocks said access opening and thereby blocks removal and insertion of said shelves and in its open position allows removal and insertion of said shelves whereby during normal operation said shelves can not be removed or installed but during maintenance and restock operations said baffle allows easy removal and installation of said shelves.

10. The storage cylinder of claim 9 where said baffle mechanism comprises a first baffle panel and a second baffle panel where both panels are approximately the same height as said access opening and moveably mounted adjacent opposite vertical edges of said access opening and further where said baffle panels can be moved horizontally between a closed and an open position such that in their closed position said baffle partially blocks said access opening to block removal and insertion of said shelves and in their open position said panels allow removal and insertion of said shelves whereby during normal operation said shelves can not be removed or installed but during maintenance and restock operations said baffle allows easy removal and installation of said shelves.

* * * * *